US005975068A

United States Patent [19]

Halter et al.

[11] Patent Number: 5,975,068

[45] Date of Patent: Nov. 2, 1999

[54] TOY GUN HAVING A RETRACTABLE SIGHT

[75] Inventors: Jeffrey T. Halter; Joseph J. Smith, both of Cincinnati, Ohio; Gerard M. O'Shea, Burlington, Ky.

[73] Assignee: Hasbro, Inc., Pawtucket, R.I.

[21] Appl. No.: 08/992,750

[22] Filed: Dec. 17, 1997

[51] Int. Cl.[6] ..... F41B 11/00

[52] U.S. Cl. ..... 124/63; 124/66; 124/80; 124/37

[58] Field of Search ..... 124/63, 65, 66, 124/80, 37

[56] References Cited

U.S. PATENT DOCUMENTS

| | | | |
|---|---|---|---|
| D. 348,700 | 7/1994 | Lin | D21/146 |
| 1,780,541 | 11/1930 | Roe | 124/66 |
| 1,817,745 | 8/1931 | Forgman et al. | 124/66 |
| 1,856,285 | 5/1932 | Fever | 124/66 |
| 2,725,869 | 12/1955 | Barber | 124/66 |
| 3,026,640 | 3/1962 | Ogdon | 40/77 |
| 3,088,451 | 5/1963 | Crosby et al. | 124/27 |
| 3,499,224 | 3/1970 | Squier et al. | 33/47 |
| 4,834,059 | 5/1989 | Moorhouse et al. | 124/67 |
| 5,016,382 | 5/1991 | Pickle | 42/100 |
| 5,244,431 | 9/1993 | D'Andrade | 446/406 |
| 5,724,954 | 3/1998 | Smith | 124/66 |

*Primary Examiner*—J. Woodrow Eldred
*Attorney, Agent, or Firm*—Marshall, O'Toole, Gerstein, Murray & Borun

[57] ABSTRACT

A toy gun having a pneumatic projectile launcher for launching a foam projectile and a retractable sighting mechanism which automatically raises to an operative viewing position when the gun is cocked. The pneumatic launcher having a plunger is concealed by a sliding housing which simulates the action of an automatic weapon, and the sight is pivotally mounted to the housing. When the gun is cocked by sliding the housing rearwardly relative to the body of the gun, the sight contacts an actuator which rotates the sight to an operative viewing position. When the gun is fired, the housing moves forwardly in unison with the plunger, and the sight automatically rotates to its inoperative position.

32 Claims, 8 Drawing Sheets

TOY GUN HAVING A RETRACTABLE SIGHT

FIELD OF THE INVENTION

The present invention relates generally to a toy gun for launching a foam projectile. More specifically, the present invention relates to a toy gun having a spring-loaded retractable sight assembly which automatically raises to an operative viewing position when the toy gun is cocked and which automatically retracts when the toy gun is fired.

BACKGROUND AND SUMMARY OF THE INVENTION

Toy air guns that launch soft foam projectiles using a blast of compressed air are generally well known in the art. Because such guns launch an actual projectile they satisfy a child's desire for realism. More importantly, because the projectiles are soft, the guns satisfy a parent's desire for safety. However, the attention span of a typical child is relatively limited, and thus the most popular toy guns are those which incorporate a variety of complex, realistic, and futuristic features. Accordingly, there is a continuing need for increasingly complex, realistic, and futuristic toy guns that will enhance the toy's play value and that will stimulate a child's imagination.

The toy gun according to the present invention incorporates the safety of a pneumatic soft foam projectile launcher with a number of complex and futuristic features that greatly enhance the play value of the toy. The gun includes a retractable sight which automatically shifts to an upright, operative position when the gun is cocked in preparation for firing. When the sight is in the operative position, a user can easily point the projectile towards an intended target. Once the intended target has been acquired, the sight automatically retracts upon firing the gun.

According to one aspect of the invention, the toy gun includes a sliding housing which moves rearwardly in unison with the plunger when the gun is cocked, thus simulating the action of an actual semi-automatic pistol. The sight, which is pivotally mounted to the housing, includes a lever or tab which contacts a concealed actuation member when the plunger is retracted, thus rotating the sight to its operative position. When the gun is fired, a spring returns the sight to its inoperative position as the tab slides off the actuation member. When in the inoperative position, the sight is protected from breakage and the gun maintains a sleek, futuristic appearance.

Accordingly, it is an object of this invention to provide an improved toy gun having a retractable sight.

Another object of this invention to provide a toy gun having a sight that extends and retracts automatically when the gun is operated.

A further object of this invention is to provide a toy gun having a sight pivotally mounted to a sliding housing that simulates the action of an actual weapon.

These and other objects of the invention will become readily apparent to those skilled in the art upon a reading of the following description.

DETAILED DESCRIPTION OF THE PREFERRED EMBODIMENT

Figure 1:
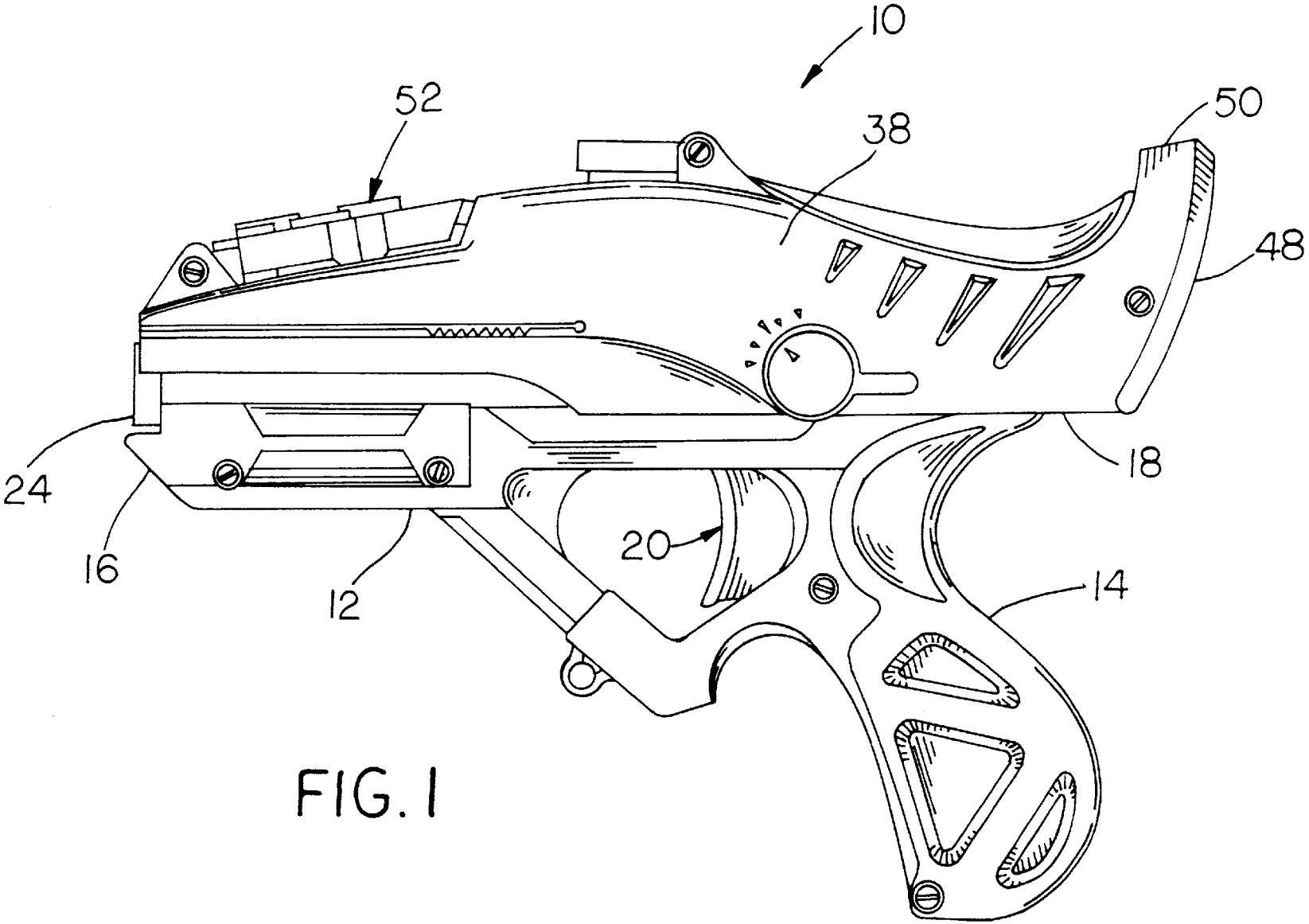
FIG. 1 is an elevational view of a toy air gun incorporating the features of the present invention and illustrating the toy gun in the uncocked position with the retractable sight in the inoperative position.

The embodiment described herein is not intended to be exhaustive or to limit the invention to the precise form disclosed. The embodiment has been chosen and described in order to best explain the principles of the invention and its application and practical use so that others skilled in the art may follow its teachings.

Referring now to the drawings, a toy air gun incorporating the features of the present invention is generally referred to by the reference numeral 10. Gun 10 includes a body 12 having a handle 14 and forward and rearward ends 16,18, respectively. A trigger assembly 20 is disposed within body 12, and is used to launch a cylindrical foam projectile or dart 22, shown in FIGS. 3 through 5, from a cylindrical launch station 24. Dart 22 fits within launch station 24 in a conventional manner.

Figure 3:
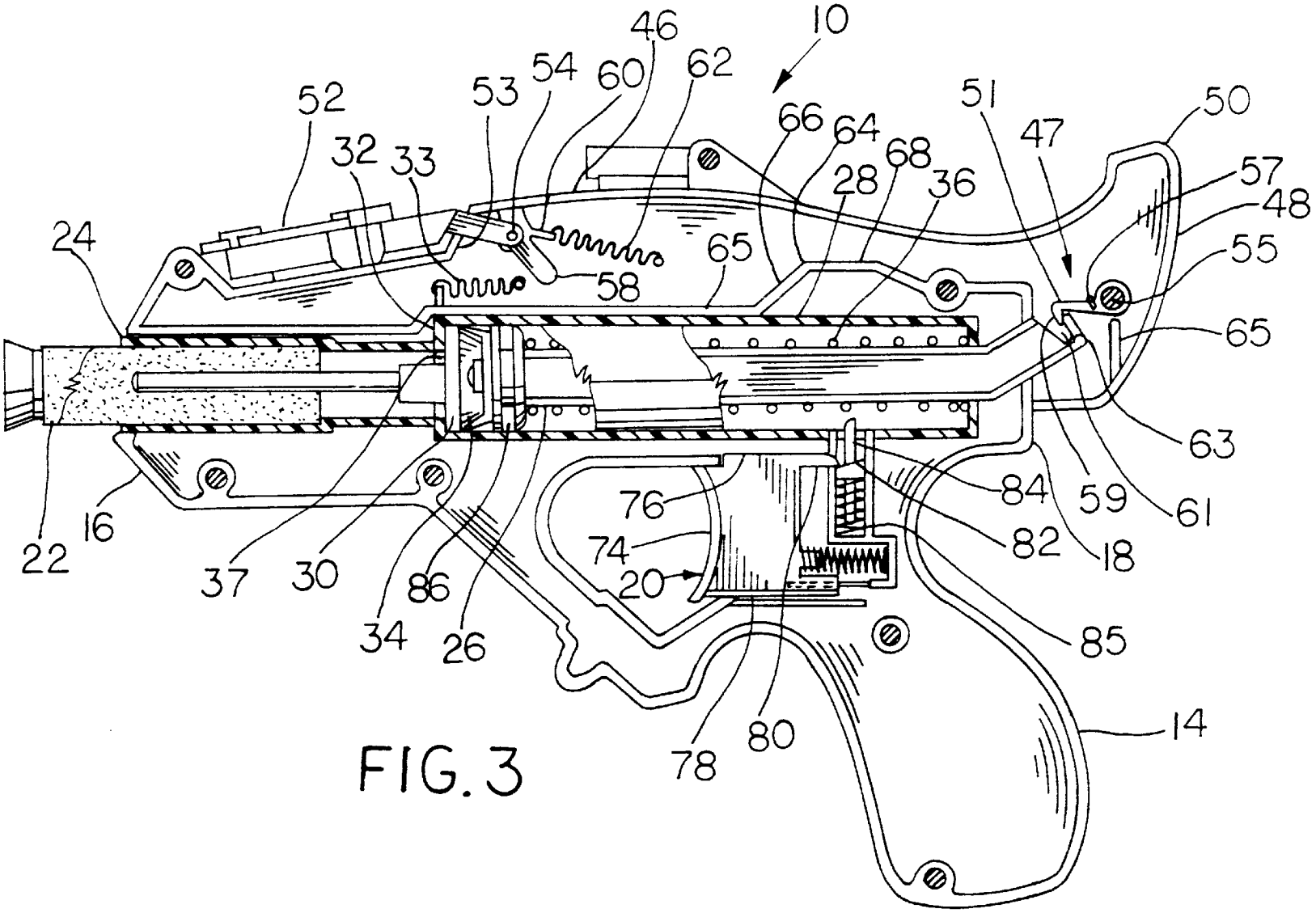
FIG. 3 is a cross-sectional view of the present toy gun in the uncocked position and with the sight in the retracted inoperative position.
Figure 4:
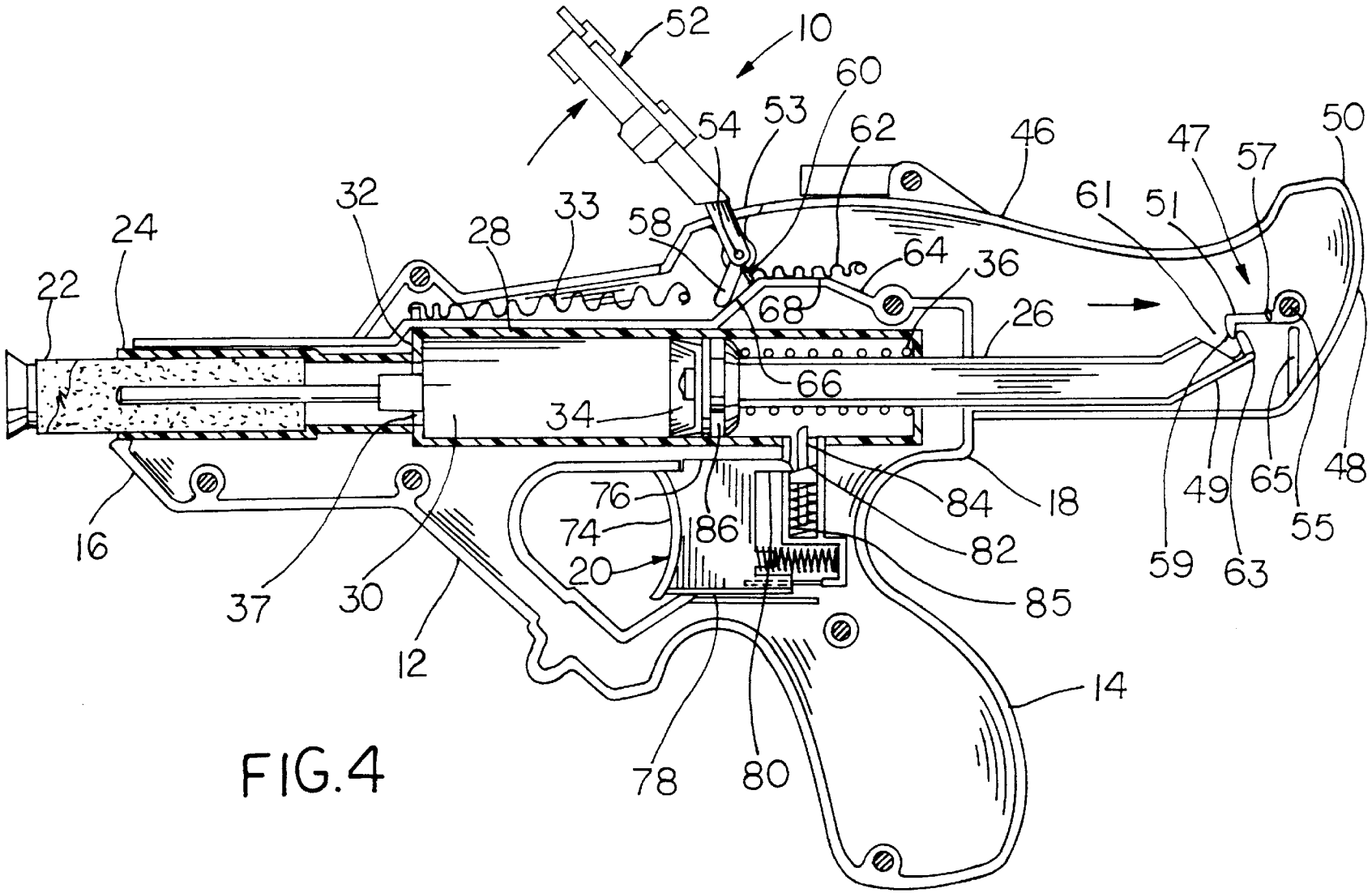
FIG. 4 is a cross-sectional view similar to FIG. 3 illustrating the sliding housing being drawn back and illustrating the retractable sight in the process of shifting to its operative position.
Figure 5:
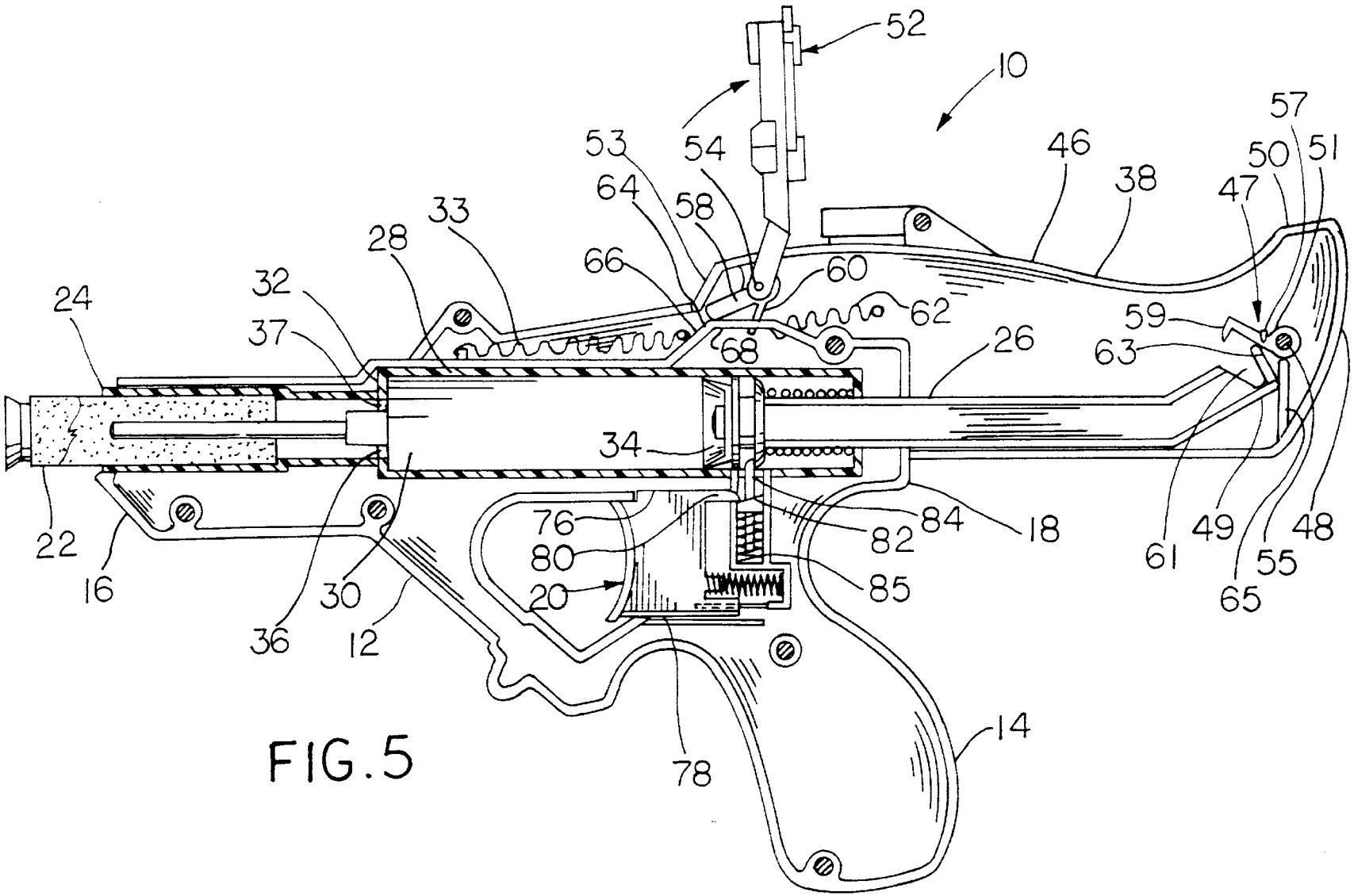
FIG. 5 is a cross-sectional view similar to FIGS. 3 and 4 but showing the gun fully cocked and the sight in the upright position.

As shown in FIGS. 3 through 5, gun 10 includes a plunger 26 that is reciprocally disposed within a cylinder 28. Plunger 26 and cylinder 28 cooperate to define a compression chamber 30 at the forward end 32 of cylinder 28. Plunger 26 includes a seal 34, and a spring 36 disposed within cylinder 28 and abutting seal 34 urges or biases plunger 26 towards the forward end 32 of cylinder 28. Compression chamber 30 includes one or more ports 37 which communicate gas or air in compression chamber 30 to launch station 24. Plunger 26 is shiftable between the uncocked forward position shown in FIG. 3 and the cocked rearward position shown in FIG. 5, in a manner commonly employed in the art.

Figure 2:
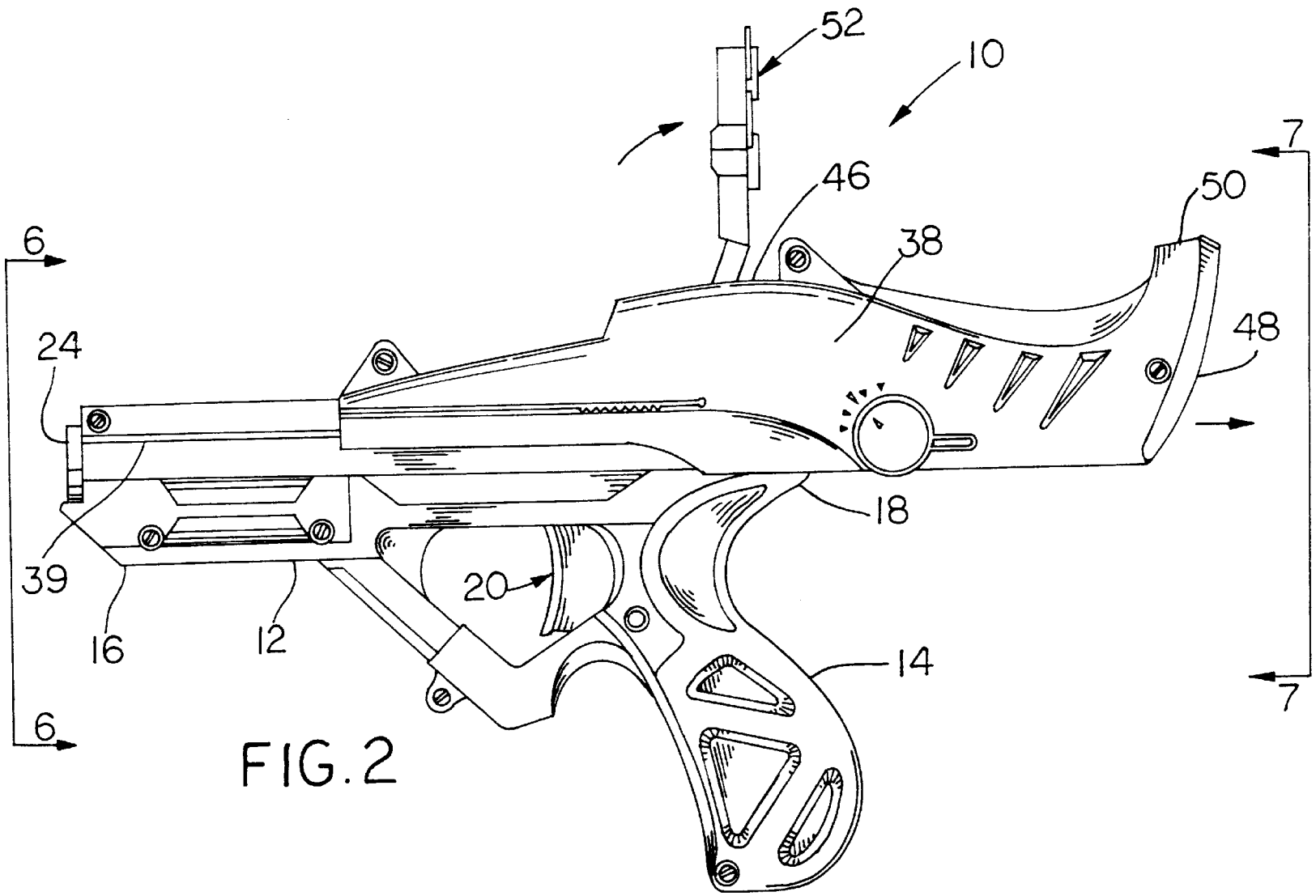
FIG. 2 is an elevational view similar to that shown in FIG. 1 but illustrating the toy gun cocked with the retractable sight in an upright operative position.
Figure 6:
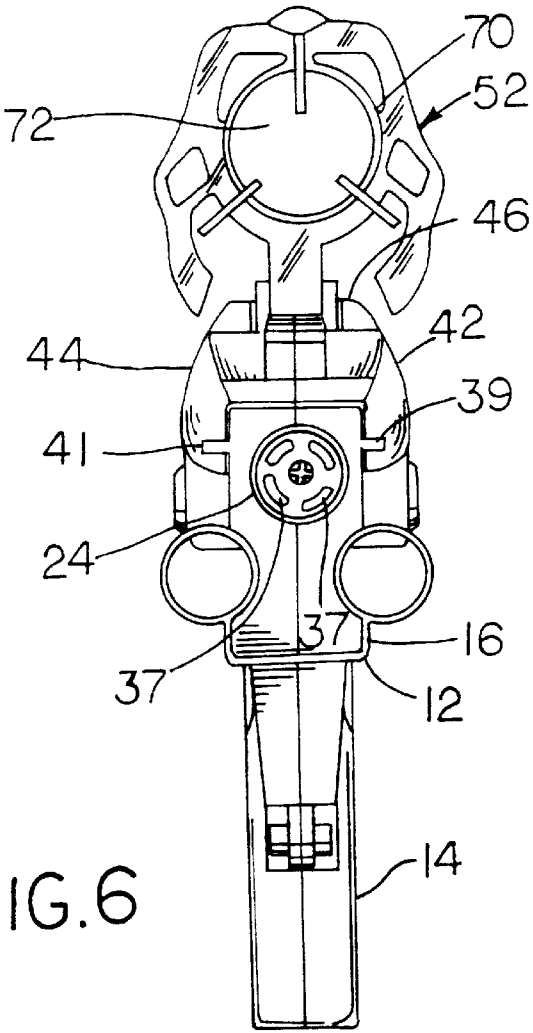
FIG. 6 is a front elevational view taken along lines 6—6 of FIG. 2.

As shown in FIGS. 1, 2 and 6, a cover or housing 38 is slidably mounted to body 12 on a pair of rails 39, 41 which serve to guide housing 38 along a generally linear path between the uncocked forward position of FIG. 1 and the cocked rearward position of FIG. 2. Housing 38 includes a pair of sides 42, 44, an interconnecting top 46, and a rearward end 48 having a handle 50. Housing 38 thus conceals the plunger 26 and the cylinder 28. A return spring 33 biases the housing 38 towards the forward position of FIGS. 1 and 3. As shown in FIGS. 3–5, a ratchet or pawl assembly 47 detachably connects the rearward end 48 of housing 38 to the rearward end 49 of plunger 26, so that plunger 26 and housing 38 slide back in unison as the gun 10 is cocked. As will be explained in greater detail below, pawl assembly 47 permits the rearward end 49 of plunger 26 to be released or de-coupled from the rearward end 48 of housing 38 when the gun 10 is fired, which improves the firing response of the gun 10.

Figure 7:
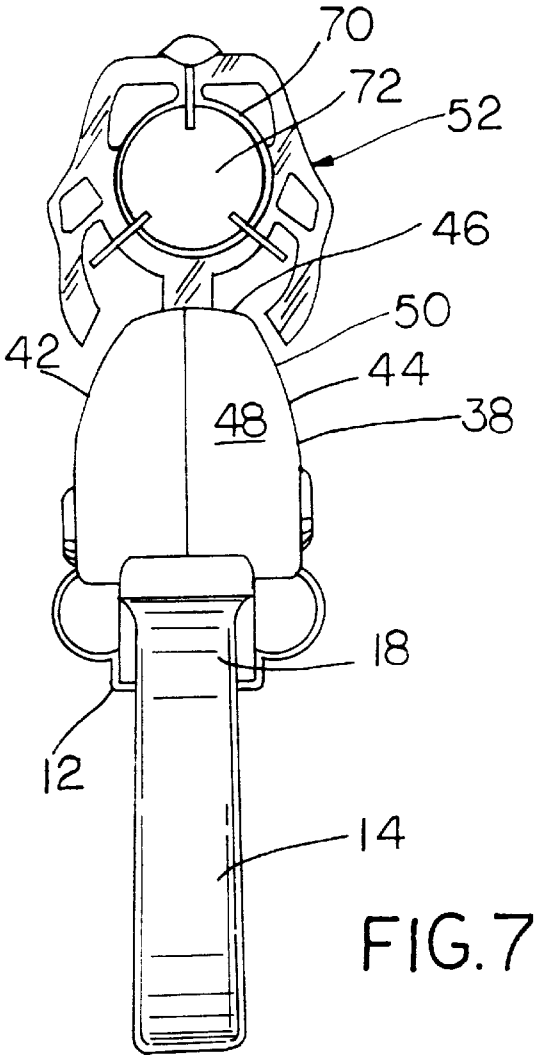
FIG. 7 is a rear elevational view taken along lines 7—7 of FIG. 2.
Figure 8:
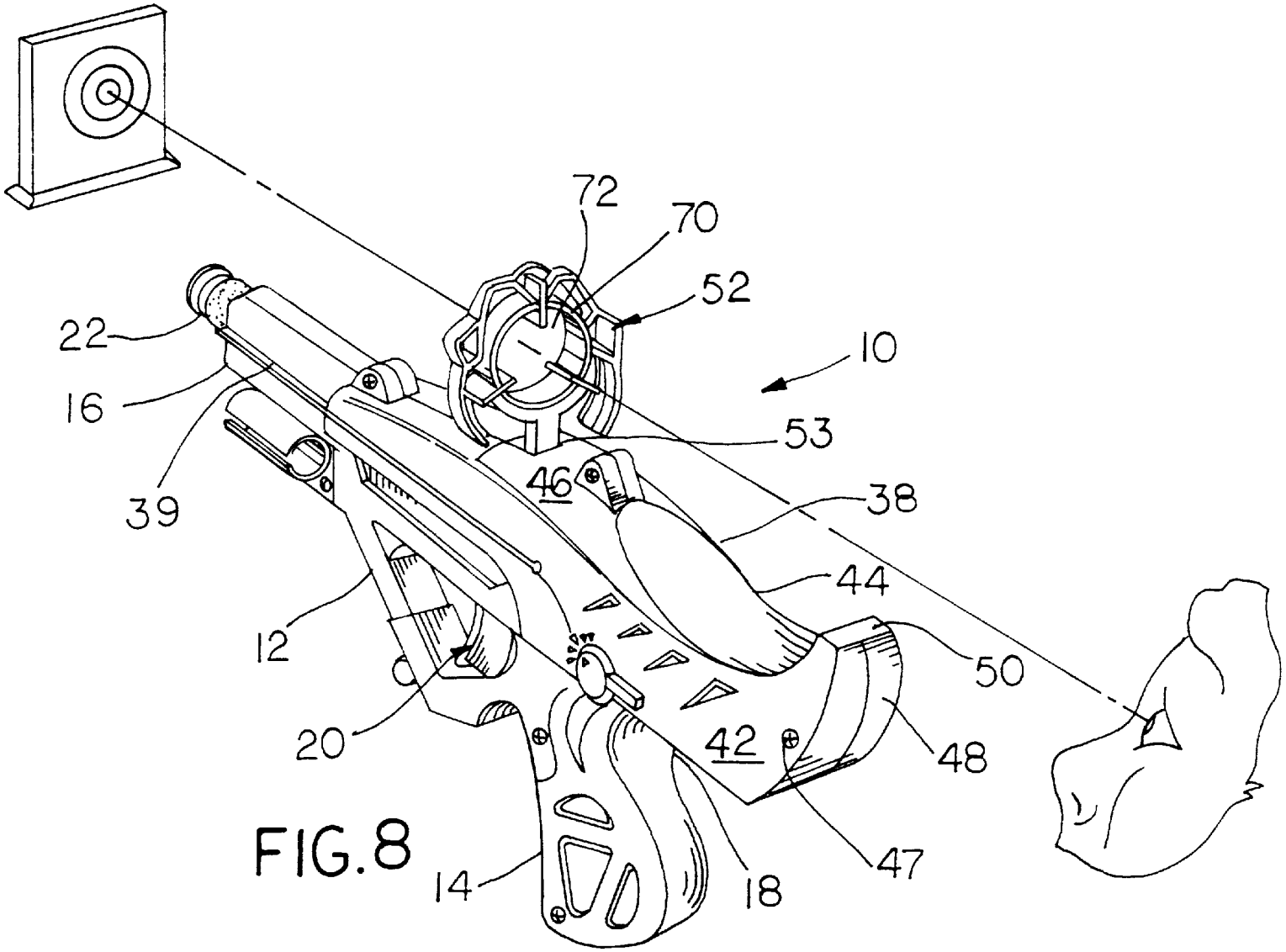
FIG. 8 is a perspective view of the present toy gun shown in the hand of a user with the retractable sight in an upright viewing position.

A sight 52 extends through an opening 53 in the top 46 of housing 38. Sight 52 is pivotally attached by a pivot 54 to the underside of top 46 of housing 38 such as by a bracket (not shown). By virtue of pivot 54, sight 52 is pivotable between the inoperative position shown in FIGS. 1 and 3 when the gun 10 is uncocked, and the generally upright operative position shown in FIGS. 2, 5 and 6–8 when the gun 10 is cocked. Sight 52 includes an actuation arm 58 and a spring tab 60 extending away from pivot 54. A tension spring 62 attached to spring tab 60 biases sight 52 towards its inoperative position. As can be seen in FIGS. 6 through 8, sight 52 includes a viewfinder 70 having a central aperture 72, which is visible to a user when the sight is in the upright operative position.

As shown in FIGS. 3 through 5, a protrusion 64 extends upwardly from the top edge 65 of body 12. Protrusion 64 includes a pair of actuating or camming surfaces 66, 68, each of which engages the actuation arm 58 on sight 52 in order to rotate the sight 52 from the folded inoperative position to the upright viewing position as the housing 38 is drawn rearwardly. It will be noted that spring tab 60 is offset laterally relative to protrusion 64 so as not to contact protrusion 64 as the sight 52 rotates. Protrusion 64 is shown generally adjacent the rearward end 18 of body 12, but could alternatively be located farther forward or rearward from the position shown without substantially altering the operation of the retractable sight 52.

As shown in FIGS. 3 through 5, trigger assembly 20 includes a finger grip 74 slidably mounted in body 12 on a set of rails 76, 78. Finger grip 74 includes an arm 80 which engages a camming surface 82 on latch pin 84. Latch pin 84 reciprocates vertically within body 12, and is upwardly biased within body 12 by a spring 85. Latch pin 84 is positioned to engage a notch 86 generally adjacent the seal 34 of plunger 26, in order to maintain the plunger in the cocked position shown in FIG. 5. Rearward movement of finger grip 74 by a user causes arm 80 to contact camming surface 82 on latch pin 84, which draws latch pin 84 out of contact with notch 86, thus allowing spring 36 to accelerate the plunger 26 and the attached housing 38 in the forward direction.

Pawl assembly 47 includes a latch member 51 which is mounted to housing 38 by a pivot 55. A rotary spring 57 biases the latch member 51 towards the latched position shown in FIG. 3 (in the counterclockwise direction when viewing the drawings), enabling the end 59 of latch member 51 to engage a cutout 61 in the rearward end 49 of plunger 26. Accordingly, when the housing 38 is retracted in order to cock the gun 10, the end 59 of latch member 51 engages the cutout 61 so that the housing 38 and the plunger 26 are drawn rearwardly in unison. When the gun 10 is fully cocked as shown in FIG. 5, the return spring 33 causes the housing 38 to be biased forwardly relative to the plunger 26. In the process, the tip 63 of plunger 26 cams against the underside of latch member 51, thus rotating the latch member in a clockwise direction against the force of the rotary spring 57. The end 59 of latch member 51 is thus disengaged from the cutout 61, and the end 49 of plunger 26 abuts a stop 65. When the gun 10 is fired, the plunger 26 accelerates forwardly. Because of the relative strength of spring 36, the end 49 of plunger 26 passes the latch member 51 before the rotary spring 57 can cause the latch member 51 to re-engage the cutout 61. The housing 38 is returned to the forward position by virtue of return spring 33. Accordingly, performance of the gun 10 is greatly improved because the spring 36 does not need to accelerate the mass of the housing 38 when the gun 10 is fired.

In operation, when it is desired to use the gun 10 to launch a dart 22, user draws the housing 38 in a rearward direction relative to the body 12 by grasping handle 50. The housing 38 is thus shifted between the uncocked position of FIGS. 1 and 3 towards the cocked position of FIGS. 2, 5 and 8. As the housing 38 is drawn rearwardly, the plunger 26 also moves rearwardly by virtue of pawl assembly 47. In the process, air is drawn drawing air into the compression chamber 30 of cylinder 28. The dart 22 is inserted into the launch station 24 in a conventional manner.

As the housing 38 and plunger 26 are being drawn rearwardly, the actuation arm 58 of sight 52 contacts camming surface 66 of protrusion 64, thus beginning the rotation of sight 52 away from its inoperative position as shown in FIG. 5. As the rearward motion of housing 38 continues, the actuation arm progresses over camming surface 66 and contacts camming surface 68, thus completing the rotation of sight 52. The sight 52 is now in the upright, operative position shown in FIGS. 6–8. When the housing 38 reaches the fully rearward or cocked position of FIG. 5, the latch pin 84 of trigger assembly 20 engages the notch 86 in plunger 26. When the gun is fully cocked, the pawl assembly 47 shifts to the de-coupled position shown in FIG. 5. The gun 10 thus remains in the cocked position until the trigger assembly 20 is actuated.

Figure 9:
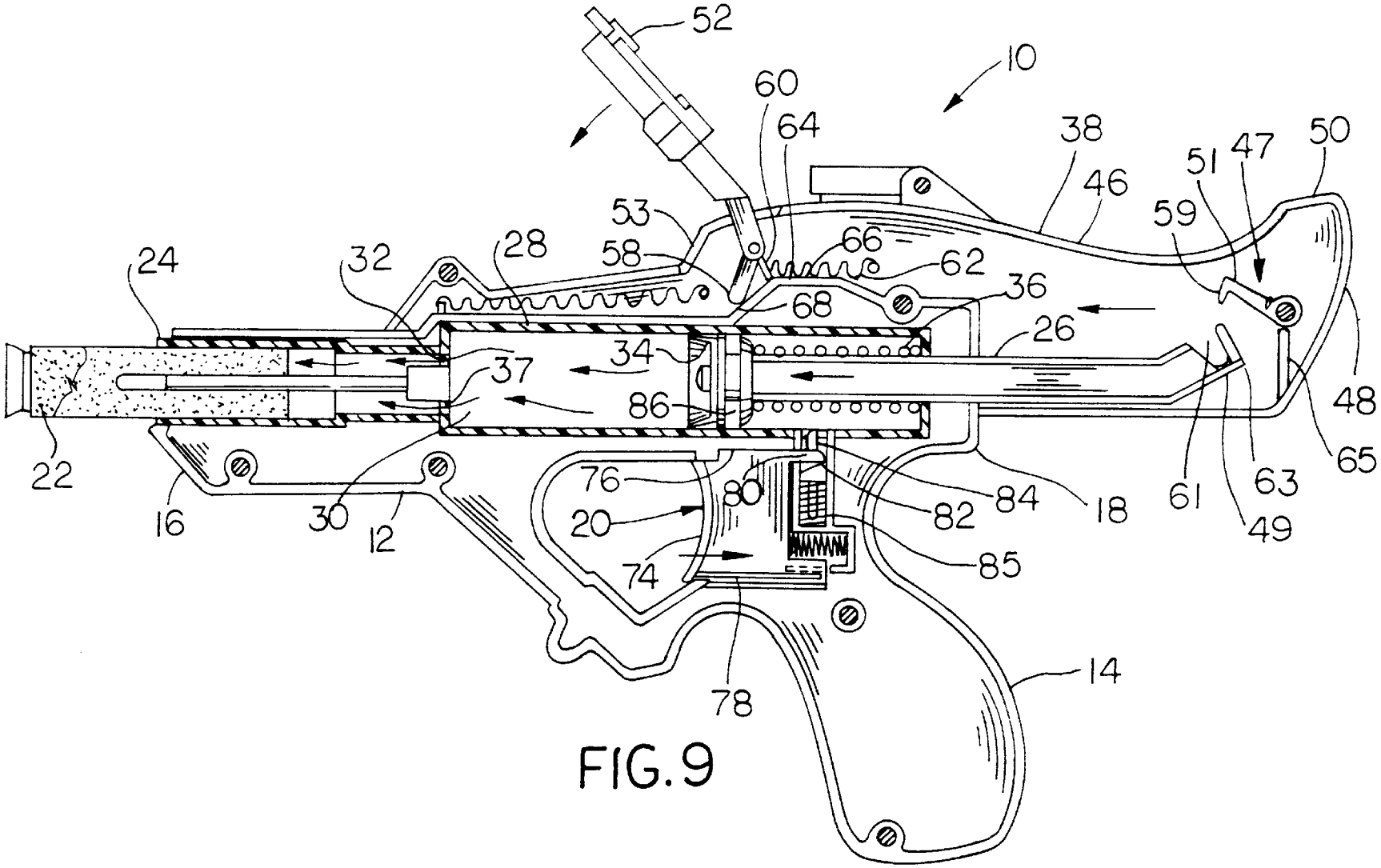
FIG. 9 is a cross-sectional view similar to FIG. 4 but illustrating the sliding housing advancing and illustrating the retractable sight in the process of shifting to its inoperative position.

When the user desires to fire the gun, the finger grip 74 is urged rearwardly so that the arm 80 cams against surface 82 on latch pin 84, drawing latch pin 84 downwardly against the force of spring 85 until the latch pin 84 disengages the notch 86 in plunger 26, which thus releases the plunger 26. The force of spring 28 against plunger 26 accelerates the plunger 26 forwardly, so that air or gas within chamber 30 is compressed and forced through the ports 37 into launch station 24, thus ejecting the dart 22 from the gun 10. As shown in FIG. 9, by virtue of pawl assembly 47 the plunger 26 is de-coupled from the housing 38.

Shortly after the gun 10 is fired, the actuation arm 58 slides off the camming surfaces 68, 66 in progression as shown in FIG. 9. Accordingly, the sight 52 rotates back to its inoperative position aided by the force of spring 62. While in the inoperative position, the sight 52 is protected from breakage. As outlined above, the return spring 33 returns the housing 38 to its original forward position.

It will be appreciated that the foregoing is presented by way of illustration only and not by way of any limitation. It is contemplated that various alternatives and modifications may be made to the described embodiment without departing from the spirit and scope of the invention.

What is claimed:

1. A toy gun for launching a foam projectile, comprising:

a body having a handle, a forward launch end, a rearward end, and a trigger, said forward launch end including a launch station sized to receive a projectile;

said body including a pneumatic launcher having a plunger and a compression chamber in flow communication with said launch station, said plunger being shiftable between a retracted position in which said plunger engages and is retained by said trigger and a forward position;

a sight operatively connected to said plunger, said sight being automatically shifted between an operative viewing position when said plunger is in said retracted position and an inoperative position when said plunger is released from said retracted position;

thereby permitting a user to align the gun with an intended target when said sight is in said viewing position.

2. The toy gun as claimed in claim 1, including a housing slidably mounted to said body, a portion of said housing being connected to said plunger, said sight being pivotally mounted to said housing and moving in unison with said housing.

3. The toy gun as claimed in claim 2, wherein said housing includes a handle for retracting said plunger.

4. The toy gun as claimed in claim 1, wherein said sight includes a lever arm and said body includes a protrusion, said lever arm contacting said protrusion as said plunger is shifted towards said retracted position thereby shifting said sight to said operative position.

5. The toy gun as claimed in claim 1, including a spring engaging said sight for biasing said sight towards said retracted position.

6. The toy gun as claimed in claim 2, including a spring engaging said sight and said housing for biasing said sight towards said retracted position.

7. The toy gun as claimed in claim 6, wherein said spring is disposed between said housing and said body, thereby concealing said spring from view.

8. The toy gun as claimed in claim 4, wherein said protrusion includes a generally planar upper surface, said lever arm engaging said upper surface when said plunger is in said retracted position.

9. The gun as claimed in claim 1, wherein said plunger includes a rearward end, and a handle attached to said plunger rearward end for drawing said plunger towards the retracted position.

10. The toy gun as claimed in claim 4, wherein said protrusion is disposed adjacent said body rearward end.

11. A toy gun for launching a foam projectile, comprising:

a body having a handle, a forward launch end, a rearward end, and a trigger, said forward launch end including a launch station sized to receive a projectile;

a plunger assembly having a forwardly biased plunger and a compression chamber in flow communication with said launch station, said plunger being shiftable between a retracted position in which said plunger engages and is retained by said trigger and a forward position;

a sight pivotally mounted to said gun and being shiftable between an operative viewing position and an inoperative position; and actuation means responsive to movement of said plunger for automatically shifting said sight between said viewing position when said plunger is moved towards said retracted position and an inoperative position when said plunger is released from said retracted position.

12. The toy gun as claimed in claim 11, including a housing slidably mounted to said body, said housing engaging and being moveable in unison with said plunger, and wherein said sight is pivotally mounted to said housing.

13. The toy gun as claimed in claim 12, wherein said housing includes a handle for retracting said plunger.

14. The toy gun as claimed in claim 11, wherein said actuation means includes a lever arm mounted to said sight, and further includes a protrusion mounted to said body, said lever arm contacting said protrusion as said plunger is shifted towards said retracted position thereby shifting said sight to said operative position.

15. The toy gun as claimed in claim 11, including a spring engaging said sight for biasing said sight towards said retracted position.

16. The toy gun as claimed in claim 12, wherein said actuation means is concealed by said housing.

17. The toy gun as claimed in claim 14, wherein said protrusion includes a generally planar upper surface, said lever arm abutting said upper surface when said plunger is in said retracted position for maintaining said sight in said operative position.

18. The toy gun as claimed in claim 14, wherein said protrusion is disposed adjacent said body rearward end.

19. A toy gun, comprising:

a body having a handle, a forward end, a rearward end, and a trigger;

a housing slidably mounted to said body, said housing being shiftable between a rearward retracted position in which said housing is retained by said trigger and a forward position;

a spring for urging said housing towards said forward position; and a sight pivotally mounted to said housing, said sight being automatically shifted between a viewing position when said housing is in said retracted position and an inoperative position when said housing is released from said retracted position.

20. A toy gun, comprising:

a body having a handle and a trigger;

a firing means mounted to said body for firing said gun, said firing means being shiftable between a cocked position engaging said trigger and an uncocked position; and a sight pivotally mounted to said body and being shiftable in response to movement of said firing means, said sight being automatically shifted between a viewing position when said firing means is cocked and an inoperative position when said firing means is released from said cocked position upon actuation of said trigger.

21. A toy gun for launching a foam projectile, comprising:

a body having a handle, a forward launch end, a rearward end, and a trigger, the forward launch end including a launch station sized to receive a projectile;

a housing slidably mounted to the body, the housing being adapted for forward and rearward movement relative to the body;

a plunger assembly having a forwardly biased plunger and a compression chamber in flow communication with the launch station, the plunger being shiftable between a retracted position retained by the trigger and a forward position;

a releasable latch carried by the housing, the releasable latch being positioned to engage the plunger so that the plunger is moveable toward the retracted position in response to rearward movement of the housing, the latch being automatically detachable from the plunger when the plunger is in the rearward position, so that upon firing of the gun the plunger advances toward the forward position independently of the housing.

22. The toy gun of claim 21, wherein the plunger assembly includes a rearward end having a slot sized to receive an end of the releasable latch, and wherein the releasable latch is shiftable between a slot engaging position and a release position.

23. The toy gun of claim 22, wherein the latch is pivotally mounted to the housing, the latch being biased towards the slot engaging position by a rotary spring.

24. The toy gun of claim 22, wherein the plunger rearward end cams against the releasable latch when the plunger is in the retracted position, thereby shifting the releasable latch to the release position.

25. The toy gun of claim 21, including a return spring engaging the housing for biasing the housing in a forward direction.

26. The toy gun of claim 21, wherein the plunger assembly includes a spring, the spring being responsive to the firing of the gun and further being adapted to advance the plunger toward the forward position before the releasable latch can engage the plunger.

27. A toy gun for launching a foam projectile, comprising:

a body having a handle, a forward launch end, a rearward end, and a trigger, the forward launch end including a launch station sized to receive a projectile;

a housing slidably mounted to the body;

a plunger assembly having a forwardly biased plunger and a compression chamber in flow communication with the launch station, the plunger being shiftable between a retracted position retained by the trigger and a forward position;

an engagement assembly for operatively connecting the plunger to the housing thereby permit the plunger to be shifted to the retracted position upon rearward movement of the housing, the engagement assembly being adapted to automatically disengage the plunger from the housing, so that upon firing the gun the forwardly biased plunger advances toward the forward position independently of the housing.

28. The toy gun of claim 27, wherein the engagement assembly includes a latch member carried by the housing, and wherein the plunger includes a rearward portion having a slot sized to receive the latch member, the latch member being shiftable between a slot engaging position and a release position.

29. The toy gun of claim 28, wherein the latch member is pivotally mounted to the housing, the latch member being biased towards the slot engaging position by a rotary spring.

30. The toy gun of claim 28, wherein the plunger rearward end cams against the latch member when the plunger is in the retracted position, thereby shifting the latch member to the release position.

31. The toy gun of claim 27, including a spring engaging the housing for biasing the housing in a forward direction.

32. The toy gun of claim 27, wherein the plunger assembly includes a spring, the plunger assembly spring being adapted to bias the plunger toward the forward position, and wherein the engagement assembly includes a spring, the engagement assembly spring being adapted to bias the engagement assembly toward the plunger, the plunger assembly spring being adapted so that upon firing of the gun the plunger assembly spring advances the plunger toward the forward position before the engagement assembly can engage the plunger.

* * * * *